United States Patent [19]

Bedell et al.

[11] Patent Number: 4,559,992

[45] Date of Patent: Dec. 24, 1985

[54] CONTINUOUS VACUUM CASTING AND EXTRACTION DEVICE

[75] Inventors: John R. Bedell, Madison; Robert W. Smith, Long Valley; Howard H. Liebermann, Succasunna, all of N.J.

[73] Assignee: Allied Corporation, Morris Township, Morris County, N.J.

[21] Appl. No.: 458,380

[22] Filed: Jan. 17, 1983

[51] Int. Cl.[4] ..... B22D 11/06

[52] U.S. Cl. ..... 164/463; 164/253; 164/415; 164/423; 164/432; 164/433; 164/434; 164/474; 164/481; 164/482

[58] Field of Search ..... 164/253, 423, 427–428, 164/432–433, 463, 474, 481–482, 415, 434

[56] References Cited

U.S. PATENT DOCUMENTS

| | | | |
|---|---|---|---|
| 2,384,500 | 9/1945 | Stell | 117/110 |
| 3,038,219 | 6/1962 | Hudson | 22/57.5 |
| 3,310,350 | 3/1967 | Armbruster et al. | 22/73 |
| 3,658,119 | 4/1972 | Hunt | 164/337 |
| 3,724,529 | 4/1973 | Chaulet et al. | 164/154 |
| 3,862,658 | 1/1975 | Bedell | 164/87 |
| 3,888,300 | 6/1975 | Guichard et al. | 164/256 |
| 4,142,571 | 3/1979 | Narasimhan | 164/88 |
| 4,154,283 | 5/1979 | Ray et al. | 164/64 |
| 4,202,404 | 5/1980 | Carlson | 164/423 |
| 4,221,257 | 9/1980 | Narasimhan | 164/87 |
| 4,301,855 | 11/1981 | Suzuki et al. | 164/415 X |

FOREIGN PATENT DOCUMENTS

| | | | |
|---|---|---|---|
| 56-68558 | 6/1981 | Japan | 164/463 |
| 1387992 | 3/1975 | United Kingdom . | |

*Primary Examiner*—Nicholas P. Godici
*Assistant Examiner*—Richard K. Seidel
*Attorney, Agent, or Firm*—Paul Yee; Ernest D. Buff; Gerhard H. Fuchs

[57] ABSTRACT

The invention provides an apparatus and method for continuously casting a filament, such as a glassy metal filament, at high speed within a zone of preselected vacuum. A continuous extrusion mechanism and a rapidly moving quench surface are located within a casting module. A vacuum mechanism provides the preselected vacuum in the module as the filament is cast, and a transport mechanism continuously moves the resultant rapidly advancing filament across the boundary between the vacuum in the casting airlock mechanism substantially preserves the module vacuum as the cast filament is transported across the boundary and a passivator mechanism passivates the quench surface to prevent the filament from adhering thereto.

14 Claims, 6 Drawing Figures

CONTINUOUS VACUUM CASTING AND EXTRACTION DEVICE

BACKGROUND OF THE INVENTION

1. Field of the Invention

The invention relates to the continuous casting of filament within a zone of effective vacuum. More particularly, the invention relates to an apparatus and method for continuously casting a glassy metal filament in a vacuum and continuously transporting the filament to an ambient atmosphere.

2. Description of the Prior Art

In the production of glassy alloy continuous filaments, typically an appropriate molten alloy is quenched at extreme quench rates, usually at least about 104° C. per second, by extruding the molten alloy from a high speed quench surface, as is representatively shown in U.S. Pat. No. 4,142,571 for "Continuous Casting Method for Metallic Strips" issued Mar. 6, 1978 to M. Narasimhan. U.S. Pat. No. 4,221,257 for "Chill Roll Casting of Amorphous Metal Strip" issued May 13, 1980 to C. Carlson discloses additional casting apparatus comprised of a rotating annular chill roll and a flexible elastomeric belt which urges a solidified filament against the casting surface of the chill roll.

A vacuum casting device for glassy metal alloys is shown in U.S. Pat. No. 4,154,283 for "Production of Improved Metal Alloy Filaments" issued May 15, 1979 to R. Ray, et al. The vacuum casting is ordinarily accomplished by locating the casting operation in an evacuated vacuum chamber. After casting a quantity of filament, the chamber is opened to remove the filament. Such procedure is particularly tedious and inefficient because it is necessary to stop the casting operation, break the seal of the vacuum chamber to remove the filament and then reseal and restart the casting operation. Because of the very high casting speeds, the cast filament accumulates very rapidly, often piling onto the casting chamber floor and requiring frequent interruption of the casting operation to remove the filament. A winder mechanism may be located in the evacuated chamber, but this would involve pumping down a chamber large enough to contain the winder device as well as the casting equipment.

Another vacuum casting apparatus is representatively shown in U.S. Pat. No. 3,888,300 for "Apparatus for the Continuous Casting of Metals and the Like Under Vacuum" issued June 10, 1975 to Guichard, et al. The apparatus casts a metal ingot within an evacuated casting chamber and moves the cast ingot on rollers through a dynamic airlock, comprised of several suction chambers, to the atmosphere. British Pat. No. 1,387,992 "Apparatus for Continuous Casting" to W. Baker, et al. published Mar. 19, 1975 discloses a mold for casting metal formed between a pair of moving belts. The belts are cooled on their reverse sides by a coolant spray, and spaced support members support the belts.

When vacuum casting filaments at high speed, however, the filament does not reliably exit the evacuated casting chamber without experiencing entanglements and choking of the material in the exit sealing structure. In addition, the quench surface often becomes sensitized, causing the cast filament to adhere or "weld" to the quench surface instead of cleanly breaking away as ordinarily occurs when such filament is cast in an atmosphere. The welding of the filament to the quench surface can damage the casting apparatus and, along with the problem of filament choking the casting chamber exit, seriously limits the present ability to continuously cast a glassy metal filament in a vacuum at high speed.

SUMMARY OF THE INVENTION

This invention provides an apparatus which continuously casts a filament, such as a glassy metal filament, within a zone of preselected vacuum. The apparatus reliably transfers the cast filament from the vacuum casting zone to an ambient zone of higher pressure, minimizes welding between the filament and the quench surface and produces filament having a superior surface finish. Generally stated, the apparatus includes a casting module which has a continuous extrusion means and a rapidly moving quench surface disposed therein. A module vacuum means produces the preselected vacuum in the module while the filament is cast, and a transport means continuously moves the resultant rapidly advancing filament across a boundary between the vacuum in the casting module and a higher pressure in an ambient zone. An airlock means preserves the module vacuum as the cast filament is continuously transported across the boundary, and a passivator means passivates the quench surface to inhibit the filament from adhering thereto.

In accordance with the invention, there is further provided a method for continuously casting a metal filament within a zone of preselected vacuum. Molten metal is extruded onto a rapidly moving quench surface within the vacuum zone to cast the filament. The quench surface is passivated to inhibit adherence of the filament to the quench surface. The filament is then continuously transported from the vacuum zone to an ambient zone of higher pressure, and the vacuum in the vacuum zone is substantially preserved by an airlock means as the filament is continuously transported therefrom.

By casting the filament in a vacuum, the apparatus of the invention improves the heat transfer during the quenching operation and improves the surface finish of the cast filament. Since the apparatus continuously removes filament from the evacuated casting chamber simultaneous with the casting operation, it eliminates the need to repeatedly interrupt the high speed casting operation to remove filament which has accumulated in the chamber. The apparatus also avoids the need to evacuate a chamber large enough to contain a high speed winder device because it efficiently preserves the vacuum in a small casting zone while continuously moving the rapidly cast filament to a winder located in the ambient atmosphere. The transport means reliably transports the filament through the airlock means without entanglements or choking, and the passivator means prevents excessive adhesion between the quench surface and cast filament that can disrupt and damage the casting operation.

Thus, the invention provides an apparatus and method for vacuum casting a continuous filament in a highly efficient manner. The filament is cast at high speed within a vacuum zone of minimum size and then continuously and simultaneously transported to an ambient atmosphere. Compared to conventional vacuum casting devices without passivator means, the invention more reliably casts and transports the filaments to the ambient atmosphere without entanglement and is less susceptible to welding between the filament and the quench surface.

BRIEF DESCRIPTION OF THE DRAWINGS

The invention will be more fully understood and further advantages will become apparent when reference is made to the following detailed description of the preferred embodiment of the invention and the accompanying drawings in which.

DESCRIPTION OF THE PREFERRED EMBODIMENTS

The invention is suitable for vacuum casting polycrystalline filament of aluminum, tin, copper, iron, steel, stainless steel or the like. However, metal alloys that, upon cooling from the melt form solid amorphous (glassy) structures are preferred. These alloys are known to those skilled in the art, and examples of such alloys are disclosed in U.S. Pat. Nos. 3,427,154; 3,981,722 and others.

Glassy metal filaments are necessarily thin, typically about 25 to 100 microns, due to the extremely rapid heat transfer rate required to prevent substantial crystallization though considerable selectivity may be exercised respecting the transverse dimensions and cross-section of the filament. Thus, in the specification and claims, the term "filament" is intended to include strips, both narrow and wide, as well as wire-like filaments. The requirement of an extremely rapid quench rate in turn necessitates casting the filament at very high speeds; the cast filament typically advancing off the quench surface at 500–2000 meters per minute.

Figure 1:
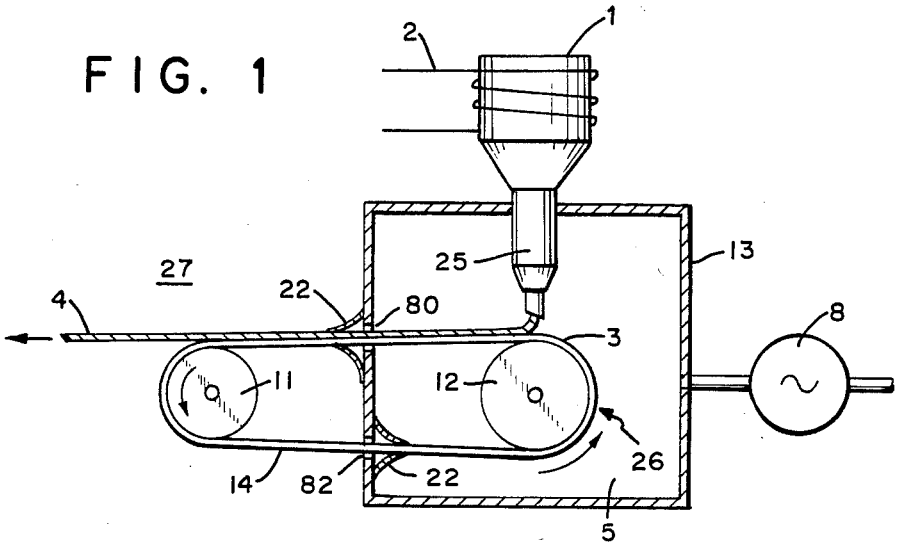
FIG. 1 is a schematic representation of the continuous casting apparatus of the invention.

Referring to FIG. 1 of the drawings, there is illustrated a representative casting apparatus adapted to continuously cast a filament, such as a glassy metal filament 4, at high speed inside a zone of preselected vacuum. A casting module 13 delimits a casting chamber 5 which has a continuous extrusion means 25 and a rapidly moving, chilled quench surface 3 disposed therein. Suitable quench surfaces can be provided by a moving endless loop casting belt, such as the shown belt 14, the peripheral surface of a rotating casting wheel or the like. Typically, the quench surface moves with a speed of at least about 500 m/min. Molten alloy contained in a crucible 1 is heated by a heating element 2 which, for example, may be an induction heater, an arc heater, a radiant heater or an electrical resistance type heater.

Pressurization of the crucible with an inert gas extrudes molten metal through an extrusion means 25 at the base of the crucible onto a quench surface 3. A module vacuum means, such as vacuum pump 8, produces the preselected vacuum, preferably having a pressure of not more than about 55 millimeters Hg, within module 13. A high speed transport means 26, comprised of the same endless belt 14 driven by drive means 11, is adapted to continuously and simultaneously move rapidly advancing filament 4 across a boundary between the vacuum in casting chamber 5 and the higher pressure in ambient zone 27. Airlock means, such as flexible or hinged seals 22 located at exit opening 80 and entrance opening 82, substantially preserve the vacuum in the casting module, and a support means 12 stabilizes the portion of casting belt 14 upon which molten metal is extruded. A passivator means is provided by the particular construction and arrangement of belt 14 which passivates quench surface 3 by exposing it to the atmosphere in ambient zone 27 as the belt moves therethrough.

Where the airlock means is comprised of seals 22, the seals are urged toward filament 4, for example by their flexible resilience, and are adapted to provide a convergent entry region thereinto which converges toward the direction of filament travel. The convergent region guides filament 4 through the seals and minimizes interference that could cause filament bunching or clogging at exit 80. Seals 22 are, for example, composed of a heat resistant elastomer or metal.

Ordinarily, the high speed vacuum casting of continuous filament is seriously limited by the tendency of the quench surface to become sensitized, and when this occurs, filament 4 adheres excessively or "welds" to quench surface 3 during the casting process. This disrupts the casting operation, and the agglomerated material welded to the quench surface can come around to strike and damage the casting equipment. Exposure to a gas, however, passivates quench surface 3 and prevents the welding of filament 4 thereto. While not intending to be limited to any particular theory, it is believed that a layer of gas molecules adsorbed onto the quench surface sufficiently passivates the surface to inhibit and substantially prevent adhesion or welding between quench surface 3 and the cast filament 4.

By casting filament 4 in a vacuum, the apparatus significantly improves the heat transfer during the quenching operation on quench surface 3. The module vacuum eliminates the atmospheric gases which tend to interpose between quench surface 3 and the extruded molten metal inhibiting the heat transfer therebetween. The apparatus also improves the as-cast surface finish of filament 4. The module vacuum eliminates gases that can cause air-pocket-type imperfections on the quench surface side of filament 4, and also eliminates the turbulent gas boundary layer that can cause waviness and other surface imperfections on the free surface side of the cast filament. Reducing these imperfections improves the uniformity of the filament cross-section.

Since the cast filament is continuously and simultaneously transported out from casting chamber 5 through the airlock means, the need to locate a high speed winder device within the casting chamber is eliminated and the size of casting module 13 is minimized.

Figure 2:
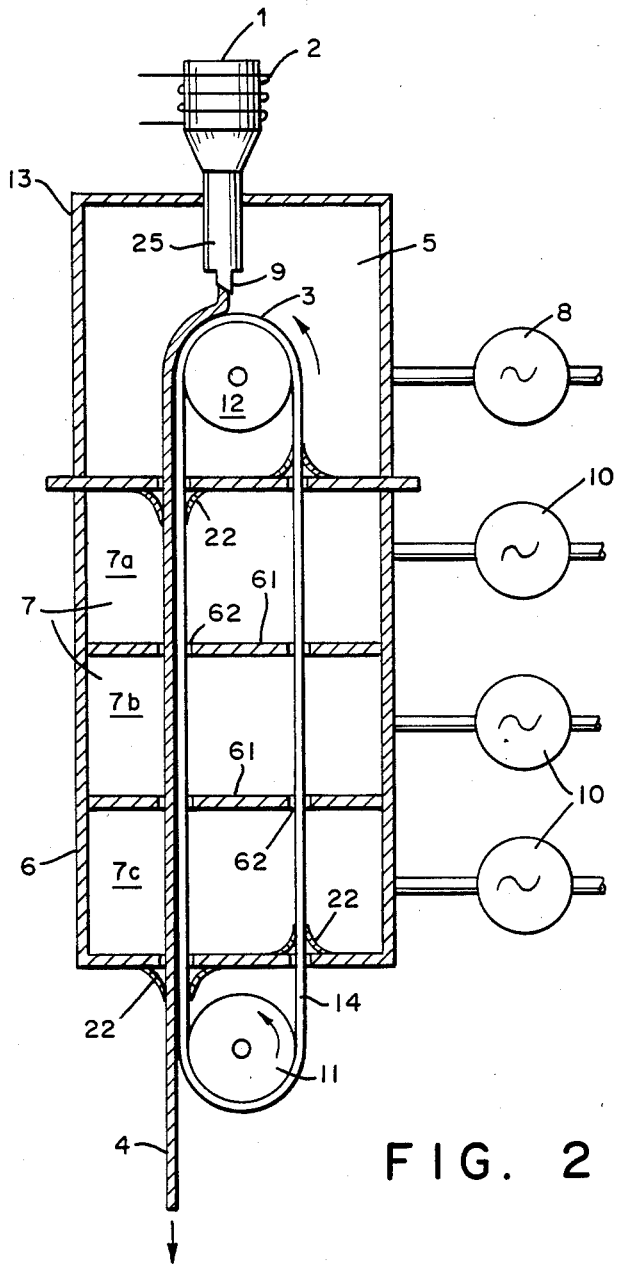
FIG. 2 is a schematic representation of the buffer enclosure of the invention.

FIG. 2 shows a preferred airlock means comprised of a buffer enclosure 6 connected to casting module 13. Buffer enclosure 6 communicates with casting chamber 5 and ambient zone 27, and delimits at least one transit chamber 7 which is adapted to pass filament 4 therethrough. Preferably, buffer enclosure 6 delimits a plurality of transit chambers disposed in series to communicate between casting chamber 5 and ambient zone 27. Individual transit chambers 7 are separated by chamber walls 61 which are provided with aligned wall openings 62 that are suitably sized and configured to pass filament 4 and belt 14 therethrough. Each of the transit chambers contains a preselected partial vacuum, with the magnitude of each partial vacuum being selectively and successively decreased in correspondence with the respective serial disposition of each transit chamber away from casting chamber 5. Thus, the partial vacuum in transit chamber 7*a* is greater than the partial vacuum in chamber 7*b*, and the partial vacuum in chamber 7*b* is greater than the partial vacuum in chamber 7*c*. Buffer vacuum means, comprised of vacuum pumps 10, provide the desired partial vacuum in each of the transit chambers 7, and optionally, seals 22 may be employed to help preserve the partial vacuums.

By using buffer enclosure 6, and particularly the buffer enclosure having a plurality of transit chambers 7 disposed in series, the apparatus greatly improves the ability to maintain the desired vacuum in casting chamber 5. Since the magnitude of vacuum in each transit chamber 7 decreases in correspondence with the serial disposition of each transit chamber from casting chamber 5, the pressure difference between successive transit chambers is only a fraction of the total pressure difference between chamber 5 and ambient zone 27. Pumps 10 are better able to maintain the individual, smaller pressure differentials; and as a result, can better preserve the desired level of vacuum in casting chamber 5. Increasing the number of transit chambers 7 further enhances the ability to preserve the desired vacuum level.

FIG. 2 further shows endless casting belt 14 also serving as a transport means for continuously moving the cast filament across the boundary between the effective vacuum in casting chamber 5 and a higher pressure in ambient zone 27. Driven by a suitable drive means 11, belt 14 continuously traverses the boundary through buffer enclosure 6 by way of wall openings 62 at a high speed of at least about 500 m/min, preferably at a speed ranging from about 1000–2000 m/min. Support means 12 stabilizes the portion of belt 14 upon which metal is extruded.

Figure 3:
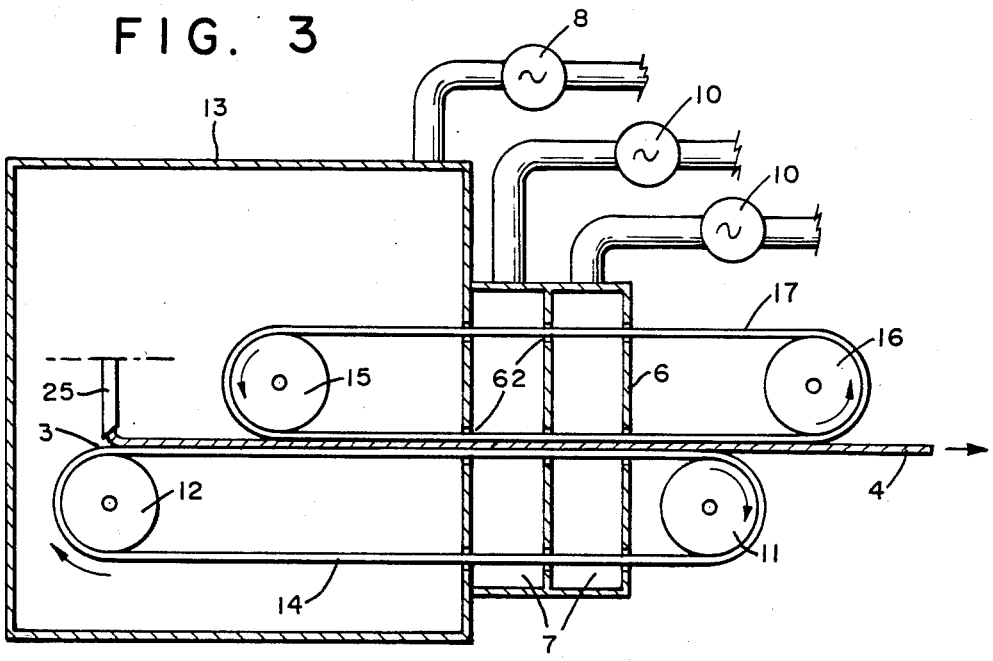
FIG. 3 is a schematic representation of the double belt transport mechanism of the invention.

Referring to FIG. 3, there is shown an endless entrainment belt 17 adapted to move in close hugging relation to belt 14 to provide a nipping type capture area between belt 14 and belt 17. Drive means 16 drives belt 17 at the appropriate velocity, and roller 15 guides the belt to provide the desired hugging relation between belt 17 and belt 14. By suitably matching the translational velocity of hugger belt 17 with the velocity of belt 14, belt 14 and belt 17 entrain filament 4 to keep it moving through the series of transit chambers 7. The shown configuration significantly improves the efficiency and effectiveness of the casting apparatus by enhancing the reliability of the transport means. With entrainment belt 17, the rapidly advancing filament 4 does not leave belt 14 and become entangled in one of the transit chambers before reaching ambient zone 27.

Figure 4:
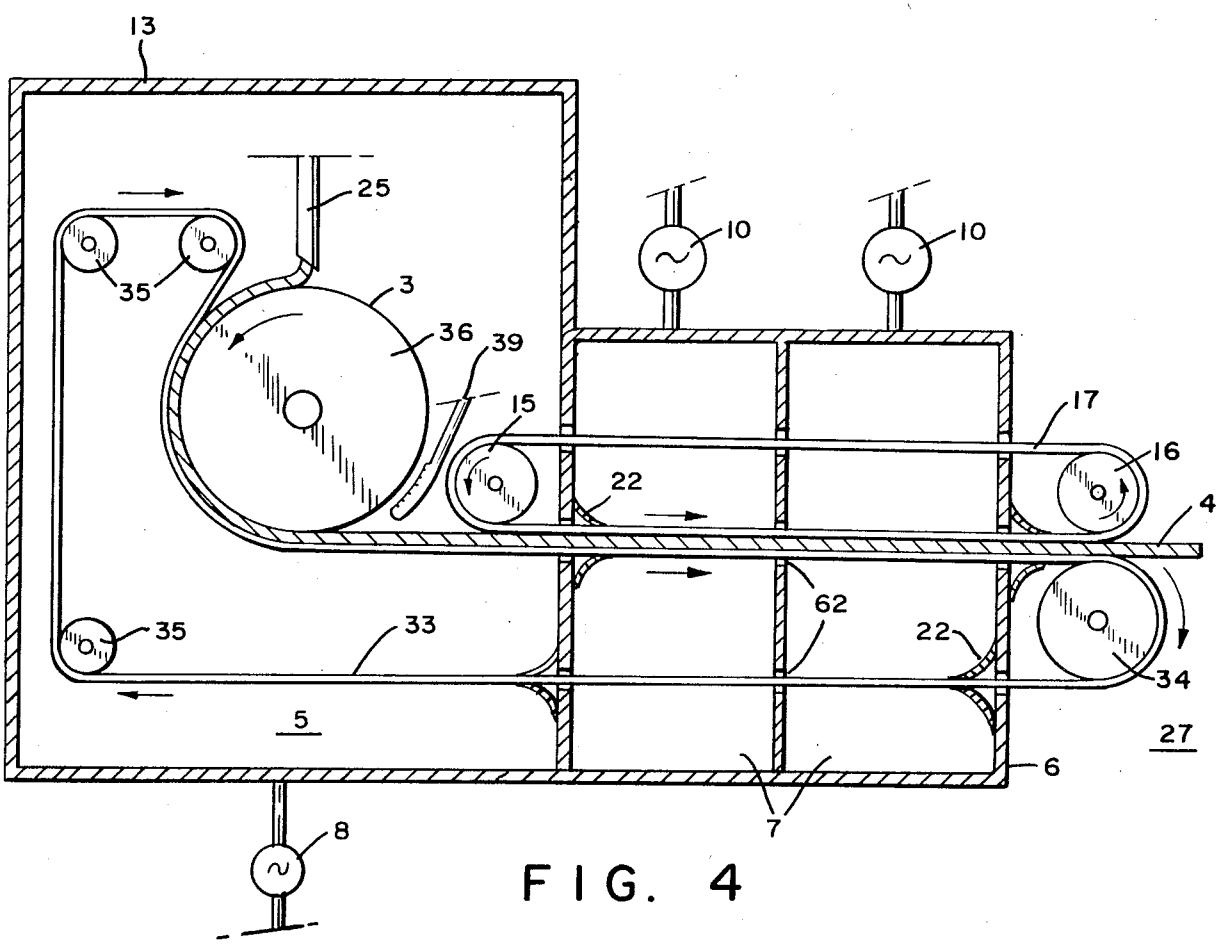
FIG. 4 is a schematic representation of the double belt transport mechanism of the invention used with a quench wheel type casting system.

FIG. 4 shows an embodiment of the invention which employs a rotating casting wheel 36 to provide quench surface 3. In this embodiment, molten metal extrudes through extrusion means 25 onto quench surface 3 of rotating casting wheel 36. Drive means 34 drives an endless transport belt 33, which is suitably guided by rollers 35, at a velocity approximately matching the peripheral velocity of wheel 36. Thusly driven, belt 33 continuously carries filament 4 around wheel 36 and into buffer enclosure 6. Entrainment belt 17 is adapted to capture filament 4 against belt 33 and facilitate its transfer through transit chambers 7 to ambient zone 27. Since casting wheel 36 is completely enclosed by casting module 13, a separate passivator means comprised of bleed nozzle 39 provides a predetermined flow of gas, such as air, to a portion of quench surface 3 as it passes by. The amount of gas provided should be great enough to passivate surface 3 but small enough that pump 8 is able to immediately evacuate it from casting chamber 5 and preserve the desired level of vacuum in the chamber.

Figure 6:
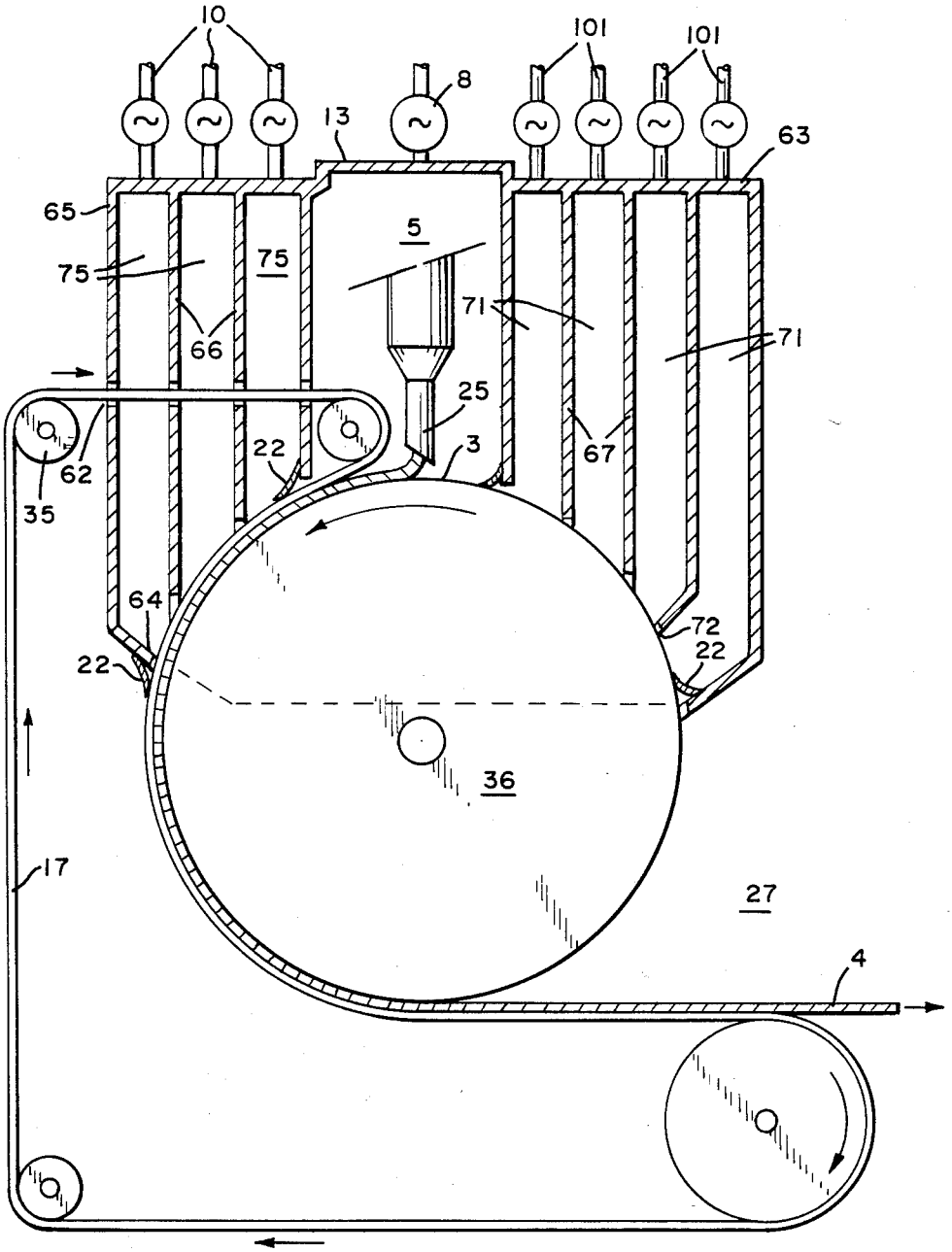
FIG. 6 is a schematic representation of another embodiment of the invention utilizing a quench wheel.

In FIG. 6, there is illustrated another embodiment of the invention utilizing a rotating casting wheel. In this embodiment, transit chambers are disposed in two distinct series about the circumference of wheel 36 and in communication with casting chamber 5. Thus, at any particular instant, the transit chambers enclose those portions of quench surface 3 which immediately precede and succeed that portion of quench surface 3 located within casting chamber 5.

Exit enclosure 65 succeeds chamber 5 and delimits a series of exit-type transit chambers 75 separated by wall members 66. Aligned wall openings 62 communicate through the walls 66 and are adapted to pass entrainment belt 17 therethrough. Wall members 66 extend into close proximity to quench surface 3 to delimit exit gaps 64 which are suitably sized and configured to pass belt 17 and entrained filament 4 therethrough. Entrance enclosure 63 precedes chamber 5 and delimits a series of entrance-type transit chambers 71 separated by wall members 67. Walls 67 extend into close proximity to quench surface 3 to delimit entry gaps 72 which are sized and configured small enough to restrict and minimize the intrusion of ambient atmosphere into entrance chambers 71 while still allowing free movement of quench surface 3 past walls 67. Vacuum pump 8 connects to casting module 13 to provide a preselected level of vacuum within casting chamber 5, and vacuum pumps 10 and 101 connect to exit chambers 75 and entrance chambers 71, respectively, to provide a preselected level of vacuum in each of the chambers. Preferably, the partial vacuum in each of the exit chambers 75 is selectively and successively decreased in correspondence with the respective serial disposition of each exit chamber away from casting chamber 5. Similarly, the partial vacuum in each of the entrance chambers 71 is selectively and successively decreased in correspondence with the respective serial disposition of each entrance chamber away from casting chamber 5.

Figure 5:
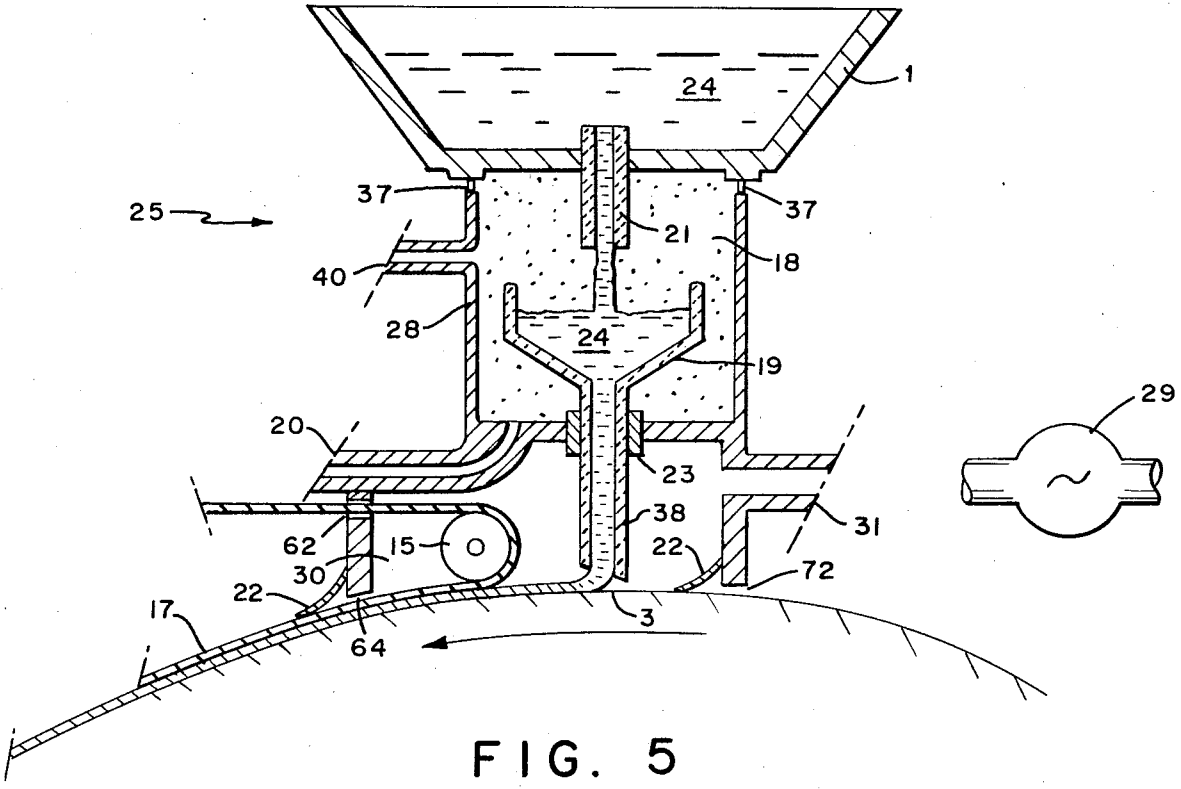
FIG. 5 is a schematic representation of a continuous extrusion device used in the invention.

FIG. 5 illustrates a preferred continuous extrusion means employed in the invention to continuously cast a filament on a chilled quench surface within a zone of preselected vacuum. In the shown embodiment, crucible 1 provides molten alloy 24 to extrusion means 25 by way of a suitable conduit 21. Extrusion means 25 is comprised of extrusion housing 28 which delimits a reservoir chamber 18 and an extrusion chamber 30. Reservoir chamber 18 contains a reservoir 19 which holds the molten metal being provided by conduit 21 and delivers it to an extrusion nozzle 38 communicating into extrusion chamber 30. Extrusion chamber 30 has a chilled quench surface 3 disposed therein, and molten metal extrudes from nozzle 38 onto surface 3 to form filament 4. An extrusion vacuum means, comprised of vacuum pump 29 connected to outlet 31, provides a preselected vacuum to extrusion chamber 30 having a pressure of not more than about 55 millimeters Hg.

Preferably, the apparatus includes a suitable source of inert gas to provide an inert atmosphere to reservoir chamber 18 at a preselected pressure by way of inlet 20 and outlet 40. This inert atmosphere prevents contamination and oxidation of the molten metal. Also, by adjusting the inert gas pressure, the molten metal extrusion rate through nozzle 38 can be controlled. Suitable flexible seals 37 preserve the desired pressures within reservoir chamber 18 and extrusion chamber 30 and provide a flexible connection between melt crucible 1 and extrusion housing 28.

By using a system with an intermediate reservoir 19, the alignment between melt crucible 1 and extrusion housing 28 is less critical, and the molten alloy in crucible 1 can be more easily and efficiently brought to a desired temperature before actually delivering it to reservoir 19 for extrusion onto quench surface 3. Also, the molten metal within nozzle 38 provides a liquid seal preserving the pressure differential between the vacuum in chamber 30 and the inert atmosphere in chamber 18.

Preferably an entrainment means, such as entrainment belt 17, is adapted to cooperate with quench surface 3 to entrain and move filament 4 out of extrusion chamber 30. In the shown embodiment, entrainment belt 17 enters extrusion chamber 30 through opening 62 and moves around guide roller 15 which is adapted to position belt 17 in close proximity to quench surface 3 to hug filament 4 against the surface. Thus, belt 17 in cooperation with quench surface 3 entrains and moves filament 4 out from extrusion chamber 30 through exit gap 64. After filament 4 has been routed away from quench surface 3, the quench surface reenters extrusion chamber 30 through an entrance gap 72, suitably configured and disposed through extrusion housing 28.

While the various embodiments of the invention have been described with separate drive means for driving the various casting surfaces, transport means and entrainment means, it should be noted that the belts and wheels, which contact one another, may in various instances friction drive one another thereby reducing the number of discrete drive means. For example, with reference to FIG. 4, a single drive means may drive casting wheel 36; wheel 36 may then drive the contacting transport belt 33, and the transport belt may in turn drive the subsequently contacting entrainment belt 17. Alternatively, the single drive means may drive transport belt 33 which, in turn, contacts and drives casting wheel 36. The latter configuration eliminates the need to extend a powered drive shaft through the wall of chamber 5 to the casting wheel.

Similarly, the separate vacuum means associated with the various embodiments of the invention may be provided by a single vacuum pump. For example, with reference to FIG. 6, vacuum pumps 8, 10 and 101 may be replaced by a single vacuum pump of appropriate capacity.

Having thus described the invention in rather full detail, it will be understood that these details need not be strictly adhered to but that various changes and modifications may suggest themselves to one skilled in the art, all falling within the scope of the invention as defined by the subjoined claims.

We claim:

1. An apparatus for transporting a rapidly advancing continuously cast filament across a boundary between a casting chamber having an effective vacuum therein and an ambient zone having a higher pressure, comprising:

(a) a buffer enclosure communicating with said casting chamber and said ambient zone which delimits at least one transit chamber adapted to pass said filament therethrough;

(b) buffer vacuum means for providing a preselected partial vacuum in said vacuum chamber;

(c) an endless transport belt traversing said boundary by way of said buffer enclosure;

(d) an endless entrainment belt adapted to move in hugging relation to said transport belt to hold said filament therebetween as said filament is transported across said boundary; and (e) drive means for driving said transport belt and entrainment belt.

2. An apparatus as recited in claim 1, wherein said buffer enclosure delimits a plurality of transit chambers disposed in series between said casting chamber and said ambient zone; each of said transit chambers having a preselected partial vacuum therein with the magnitude of each of said partial vacuums being selectively decreased in correspondence with the respective serial disposition of each transit chamber from said casting chamber.

3. An apparatus for continuously casting a filament within a zone of preselected vacuum, comprising:

(a) a casting module which delimits a casting chamber having a continuous extrusion means and a rapidly moving quench surface disposed therein;

(b) module vacuum means for producing said preselected vacuum in said casting module while said filament is rapidly cast;

(c) transport means for continuously moving the resultant rapidly advancing filament across a boundary between the effective vacuum in said casting module and a higher pressure in an ambient zone, said transport means comprising an endless entrainment belt adapted to move in hugging relation to said quench surface to provide a capture area therebetween for transporting said filament;

(d) drive means for moving said belt;

(e) airlock means for substantially preserving said module vacuum as said filament is continuously transported across said boundary, said airlock means constructed to pass said belt and the entrained filament therethrough; and (f) passivator means for passivating said quench surface to inhibit adherence of said filament to said quench surface.

4. A method for continuously casting a metal filament within a zone of preselected vacuum, comprising the steps of:

(a) extruding molten metal onto a rapidly moving quench surface within said zone of preselected vacuum to cast said filament;

(b) passivating said quench surface by an exposure to a gas to inhibit adherence of said filament thereto;

(c) capturing said filament between said quench surface and a moving endless entrainment belt within said vacuum zone; and (d) moving said entrainment belt and said captured filament through an airlock means, which substantially preserves the vacuum in said vacuum zone, to continuously transport said filament from said vacuum zone to an ambient zone of higher pressure.

5. A method for continuously casting a metal filament within a zone of preselected vacuum, comprising the steps of:

(a) enclosing in said vacuum zone a rotatable casting wheel having a quench surface thereon;

(b) extruding molten metal onto said quench surface to cast said filament;

(c) bleeding a flow of gas onto said quench surface to inhibit adherence of said filament thereto;

(d) capturing said filament between said quench surface and a moveable endless entrainment belt within said vacuum zone; and (e) moving said belt and said entrainment filament through an airlock means, which substantially preserves the vacuum in said vacuum zone, to continuously transport said filament from said vacuum zone to an ambient zone of higher pressure.

6. An apparatus for continuously casting a filament within a zone of preselected vacuum, comprising:

(a) a casting module which delimits a casting chamber having a continuous extrusion means and a rapidly moveable quench surface disposed therein;

(b) module vacuum means for producing said preselected vacuum in said casting module while said filament is rapidly cast;

(c) airlock means for substantially preserving said module vacuum as said filament is continuously transported across a boundary between the effective vacuum in said casting module and a higher pressure in an ambient zone, said airlock means constructed to pass said filament therethrough;

(d) passivator means for passivating said quench surface to inhibit adherence of said filament to said quench surface;

(e) transport means for continuously moving the resultant rapidly advancing filament across said boundary, said transport means comprising an endless entrainment belt which crosses said boundary into said casting chamber through said airlock means and moves in hugging relation to said quench surface to provide a capture area between said entrainment belt and quench surface, and which transports said filament through said airlock means and out from said casting chamber; and (f) drive means for moving said entrainment belt.

7. An apparatus as recited in claim 6, wherein said quench surface is provided by a rotating casting wheel.

8. An apparatus as recited in claim 6, wherein said quench surface is provided by a moving, endless casting belt.

9. An apparatus as recited in claim 6, wherein said airlock means comprises:

(a) a buffer enclosure communicating with said casting chamber and said ambient zone comprised of at least one transit chamber adapted to pass said filament therethrough; and (b) buffer vacuum means for providing a preselected partial vacuum in said transit chamber.

10. An apparatus as recited in claim 9, wherein said buffer enclosure delimits a plurality of transit chambers disposed in series to communicate between said casting chamber and said ambient zone; each of said transit chambers having a preselected partial vacuum therein with the magnitude of each of said partial vacuums being selectively decreased in correspondence with the respective serial disposition of each transit chamber from said casting chamber.

11. An apparatus as recited in claim 6, wherein said transport means further comprises:

(a) an endless transport belt which continuously traverses said boundary through said airlock means and which moves in hugging relation to said entrainment belt to provide a capture area therebetween for transporting the entrained filament through said airlock means; and (b) drive means for moving said transport belt.

12. An apparatus for continuously casting a filament within a zone of preselected vacuum, comprising:

(a) a casting module which delimits a casting chamber that encloses a rotatable casting wheel and has a continuous extrusion means disposed therein;

(b) module vacuum means for producing said preselected vacuum in said casting module while said filament is rapidly cast;

(c) passivator means for passivating said quench surface to inhibit adherence of said filament to said quench surface, said passivator means comprised of a nozzle that bleeds a flow of gas onto a quench surface of said casting wheel;

(d) airlock means for substantially preserving said module vacuum as said filament is continuously transported across a boundary between the effective vacuum in said casting module and a higher pressure in an ambient zone, said airlock means constructed to pass said filament therethrough;

(e) transport means for continuously moving the resultant rapidly advancing filament across said boundary, said transport means comprising an endless entrainment belt which enters said casting chamber through said airlock means and moves in hugging relation to said quench surface to provide a capture area between said entrainment belt and said quench surface and which transports said filament through said airlock means; and (f) drive means for moving said entrainment belt.

13. An apparatus as recited in claim 12, wherein said transport means further comprises:

(a) an endless transport belt which continuously traverses said boundary through said airlock means and which moves in hugging relation to said entrainment belt to provide a capture area therebetween for transporting the filament through said airlock means; and (b) drive means for moving said transport belt.

14. A continuous extrusion apparatus for continuously casting a filament on a rapidly moving quench surface within a zone of preselected vacuum, comprising:

(a) a crucible for providing molten metal;

(b) a housing for delimiting a reservoir chamber and an extrusion chamber, said extrusion chamber having said quench surface disposed therein;

(c) a flexible seal between said crucible and said housing;

(d) an intermediate reservoir disposed within said reservoir chamber and spaced from said crucible for holding molten metal provided from said crucible;

(e) nozzle means communicating between said reservoir and said extrusion chamber for providing a liquid seal between said reservoir chamber and said extension chamber when extruding molten metal onto said quench surface;

(f) extrusion vacuum means for providing said preselected vacuum in said extension chamber;

(g) gas means for providing an atmosphere of inert gas within said reservoir chamber at a preselected pressure that controls an extrusion rate of said molten metal onto said quench surface; and (h) an endless entrainment belt which enters into said extrusion chamber and is positioned therein to hug said filament against said quench surface and cooperate therewith to move said filament out from said extrusion chamber.

* * * * *